US011215943B2

(12) United States Patent
Nakagawa

(10) Patent No.: US 11,215,943 B2
(45) Date of Patent: Jan. 4, 2022

(54) FIXING DEVICE FOR TONER IMAGE TO SHEET AND IMAGE FORMING APPARATUS PROVIDED WITH FIXING DEVICE

(71) Applicant: KYOCERA Document Solutions Inc., Osaka (JP)

(72) Inventor: Takafumi Nakagawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/887,358

(22) Filed: May 29, 2020

(65) Prior Publication Data

US 2020/0379389 A1 Dec. 3, 2020

(30) Foreign Application Priority Data

May 30, 2019 (JP) ..... JP2019-100879

(51) Int. Cl.
*G03G 15/20* (2006.01)

(52) U.S. Cl.
CPC ..... *G03G 15/2053* (2013.01); *G03G 15/2017* (2013.01)

(58) Field of Classification Search
CPC ..... G03G 15/2053; G03G 15/2017; G03G 2215/2035; G03G 2215/2016; G03G 2215/2041
See application file for complete search history.

(56) References Cited

U.S. PATENT DOCUMENTS 9,239,556 B2 * 1/2016 Egi ..... G03G 15/2053
2009/0041515 A1 * 2/2009 Kim ..... G03G 15/2025 399/324
2013/0209147 A1 * 8/2013 Ogawa ..... G03G 15/2053 399/329

FOREIGN PATENT DOCUMENTS

JP 2014-149446 A 8/2014

* cited by examiner

*Primary Examiner* — Arlene Heredia
(74) *Attorney, Agent, or Firm* — Studebaker & Brackett PC

(57) ABSTRACT

A fixing device to fix an unfixed toner image to the sheet includes a fixing belt, a guide plate, a support member and a pressing roller. The fixing belt has endless shape and rotates with a conveyance of the sheet. The guide plate guides the fixing belt from an inside of the fixing belt so as to rotate. The support member supports the fixing belt along a conveyance path of the sheet from the inside. The pressing roller presses the fixing belt on the support member from an outside of the fixing belt. The fixing belt has a belt width wider than a guide width of the guide plate in a rotational axial direction of the fixing belt. Both end edges of the guide plate in the rotational axial direction are formed to have a shape containing a shape not parallel to a rotational direction of the fixing belt.

3 Claims, 9 Drawing Sheets

FIXING DEVICE FOR TONER IMAGE TO SHEET AND IMAGE FORMING APPARATUS PROVIDED WITH FIXING DEVICE

INCORPORATION BY REFERENCE

This application is based on and claims the benefit of priority from Japanese patent application No. 2019-100879 filed on May 30, 2019, which is incorporated by reference in its entirety.

BACKGROUND

The present disclosure relates to a fixing device and an image forming apparatus.

An electrophotographic type image forming apparatus, such as a copying machine and a printer, includes a fixing device which fixes an unfixed toner image on a sheet. A belt-fixing type fixing device is known, which fixes the toner image on the sheet by passing the sheet between a fixing belt and a pressing roller under a heating condition. Inside the fixing belt, a guide plate which guides the fixing belt and a supporting member which supports the fixing belt along a sheet conveyance path are provided. In the fixing device, the fixing belt is rotated along the guide plate while being pressed on the supporting member by the pressing roller to form a fixing nip.

SUMMARY

In accordance with an aspect of the present disclosure, a fixing device to fix an unfixed toner image transferred on a sheet to the sheet includes a fixing belt, a guide plate, a support member and a pressing roller. The fixing belt has endless shape and rotates with a conveyance of the sheet. The guide plate guides the fixing belt from an inside of the fixing belt so as to rotate. The support member supports the fixing belt along a conveyance path of the sheet from the inside. The pressing roller presses the fixing belt on the support member from an outside of the fixing belt. The fixing belt has a belt width wider than a guide width of the guide plate in a rotational axial direction of the fixing belt. Both end edges of the guide plate in the rotational axial direction are formed to have a shape containing a shape not parallel to a rotational direction of the fixing belt.

In accordance with an aspect of the present disclosure, an image forming apparatus includes an image forming part forming the unfixed toner image on the sheet and the fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
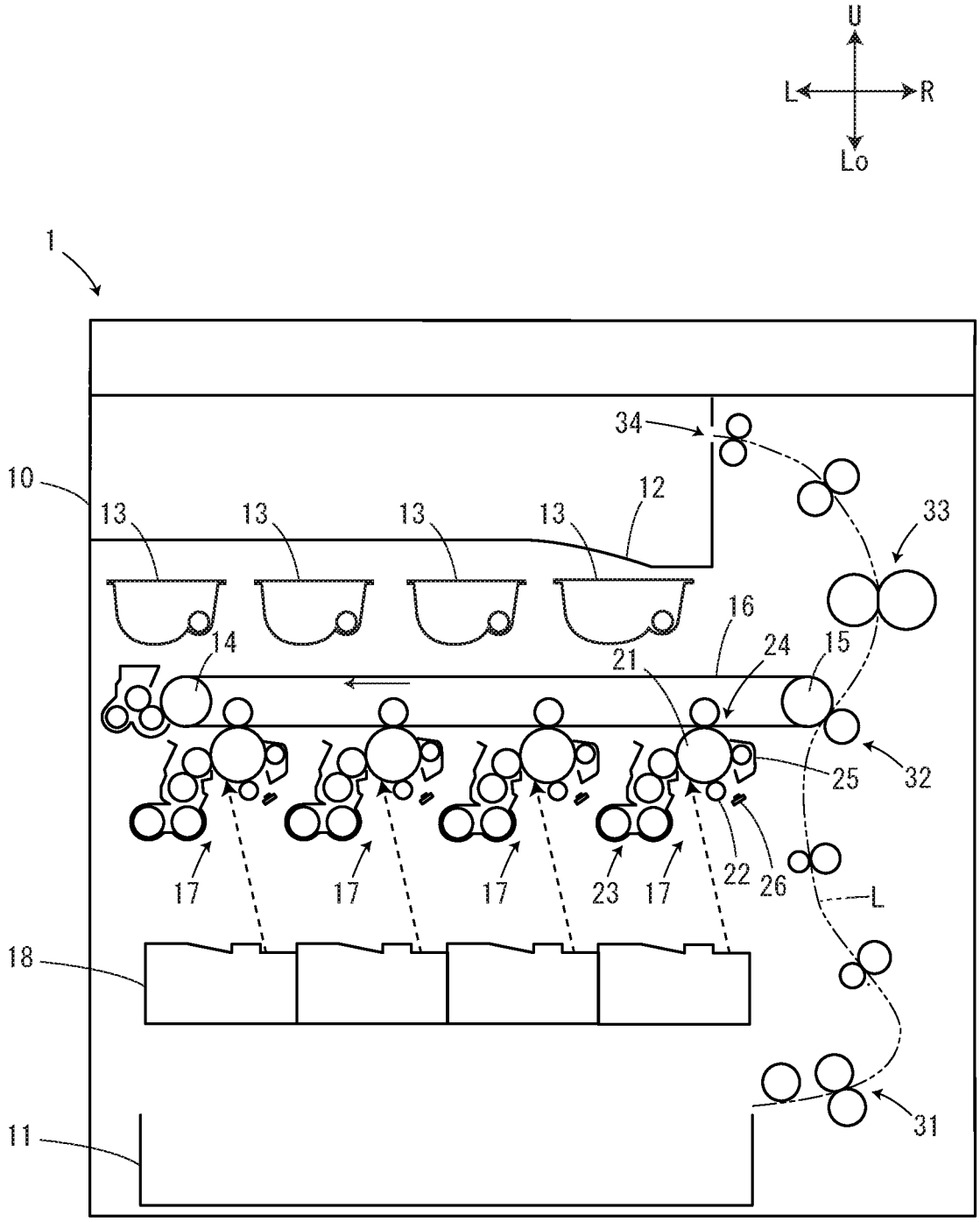
FIG. 1 is a view schematically showing a printer according to one embodiment of the present disclosure.

Hereinafter, an image forming apparatus including a fixing device according to an embodiment of the present disclosure will be described with reference to the drawings. In the following description, a printer as an example of the image forming apparatus will be described. FIG. 1 is a view schematically showing the printer according to the embodiment. For convenience for explanation, a front side on a paper surface of FIG. 1 is defined as a front side of the printer, and the left-and-right direction is based on a direction in which the printer is viewed from the front side. Arrows Fr, Rr, L, R, U and Lo marked in each figure respectively show a front side, a rear side, a left side, a right side, an upper side and a lower side of the printer.

As shown in FIG. 1, the printer 1 includes a box-like shaped housing 10 in which various devices are stored. In the lower portion of the housing 10, a sheet feeding cassette 11 in which a plurality of sheets is set is stored, and in the upper portion of the housing 10, a discharge tray 12 on which the sheet on which an image has been formed is stacked is provided. Below the discharge tray 12, toner containers 13 containing toners are detachably set for each color (for example, four colors containing magenta, cyan, yellow and black) of the toner. Below the toner containers 13, an intermediate transferring belt 16 wound around a pair of left and right rollers 14 and 15 is provided.

Along the lower portion of the intermediate transferring belt 16, image forming parts 17 are provided side by side in the left-and-right direction for each color of the toner. Each image forming part 17 includes a rotatable photosensitive drum 21 coming into rolling-contact with the intermediate transferring belt 16. Around the photosensitive drum 21, a charging device 22, a development device 23, a primary transferring part 24, a cleaning device 25 and an eraser 26 are disposed in the order of the primary transferring process. Each development device 23 is supplied with the toner from the corresponding toner container 13 through a supplying path (not shown). Below the image forming parts 17, an exposure device 18 containing a laser scanning unit (LSU) is provided.

In the right side portion of the inside of the housing 10, a sheet conveyance path L is formed from the sheet feeding cassette 11 to the discharge tray 12 by a plurality of rollers. At the upstream side end (the lower end) of the conveyance path L, a sheet feeding part 31 is provided, and on a downstream side of the sheet feeding part 31 on the conveyance path L, a secondary transferring part 32 is provided on a right end side of the intermediate transferring belt 16. At the downstream portion of the secondary transferring part 32 on the conveyance path L, a fixing device 33 is provided, and at the downstream end (the upper end) of the conveyance path L, a discharge port 34 is provided. The sheet may be a sheet-shaped one on which an image is to be formed, and contains a plain paper, a coating sheet, a tracing paper, an OHP (Over Head Projector) sheet or the like.

When the printer 1 forms an image, the charging device 22 charges the surface of the photosensitive drum 21, and then the exposure device 18 emits laser light on the surface of the photosensitive drum 21 to form an electrostatic latent image on the surface of the photosensitive drum 21. Next, the toner is supplied to the electrostatic latent image on the surface of the photosensitive drum 21 to form a toner image, and then the toner image is primarily transferred from the surface of the photosensitive drum 21 to the surface of the intermediate transferring belt 16. In the image forming parts 17, the toners of the corresponding colors are primarily transferred to form a full color toner image on the surface of the intermediate transferring belt 16. The toner and the charge remaining on the photosensitive drum 21 are removed by the cleaning device 25 and the eraser 26 respectively.

On the other hand, the sheet is fed from the sheet feeding cassette 11 or a manual bypass tray (not shown) by the sheet feeding part 31, and conveyed to the secondary transferring part 32 at a timing in accordance to the above image forming operation. At the secondary transferring part 32, the full color toner image is secondarily transferred from the surface of the intermediate transferring belt 16 to the surface of the sheet, and then the sheet on which the full color toner image has been transferred is conveyed to the fixing device 33 disposed downstream the secondary transferring part 32. The fixing device 33 fixes the toner image on the sheet, and then the sheet on which the toner image has been fixed is discharged through the discharge port 34 onto the discharge tray 12. As described above, the toner image transferred on the sheet is passed through the fixing device 33 to form the image on the sheet.

Figure 2:
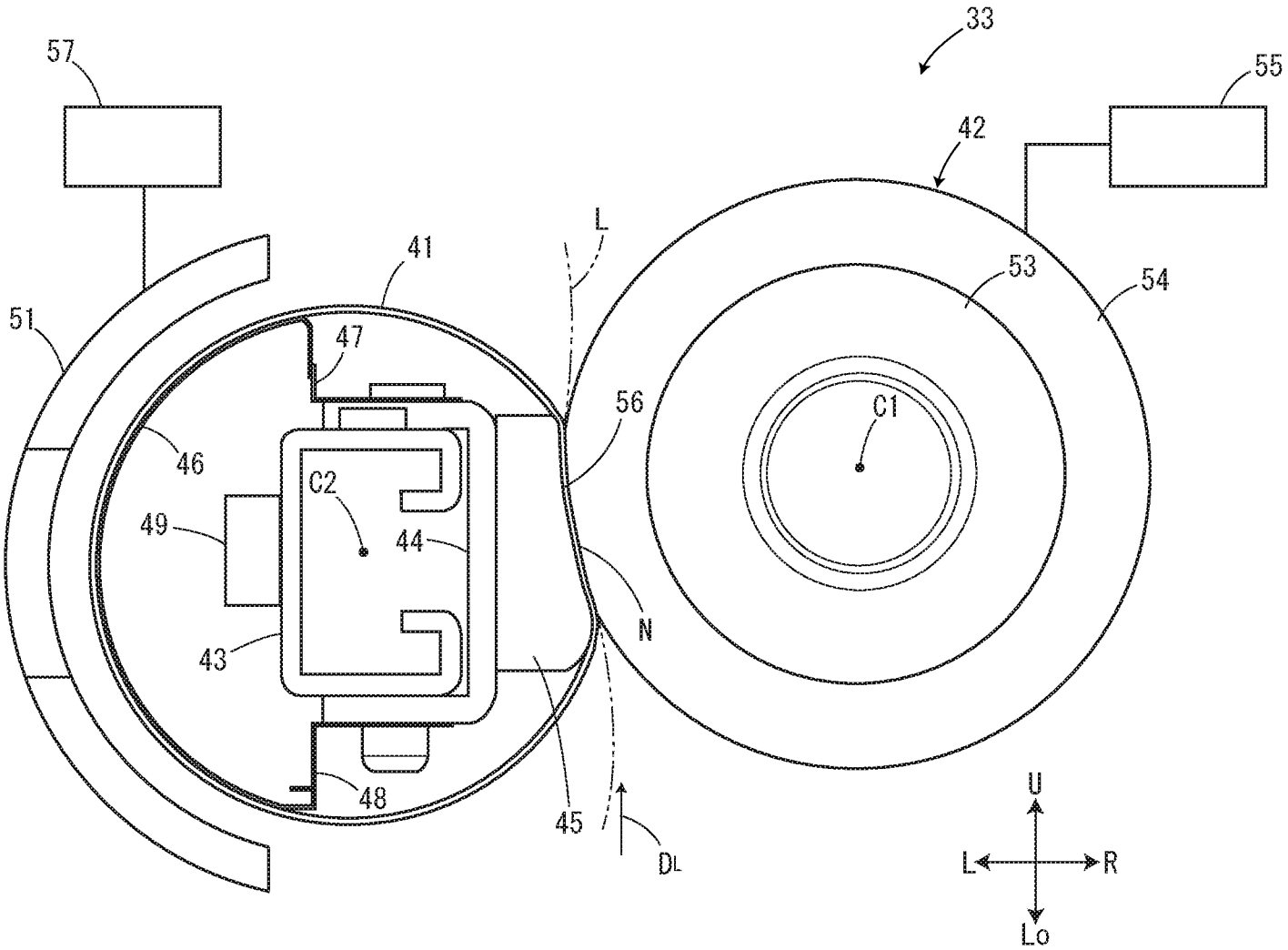
FIG. 2 is a view schematically showing a fixing device according to the embodiment of the present disclosure.
Figure 3:
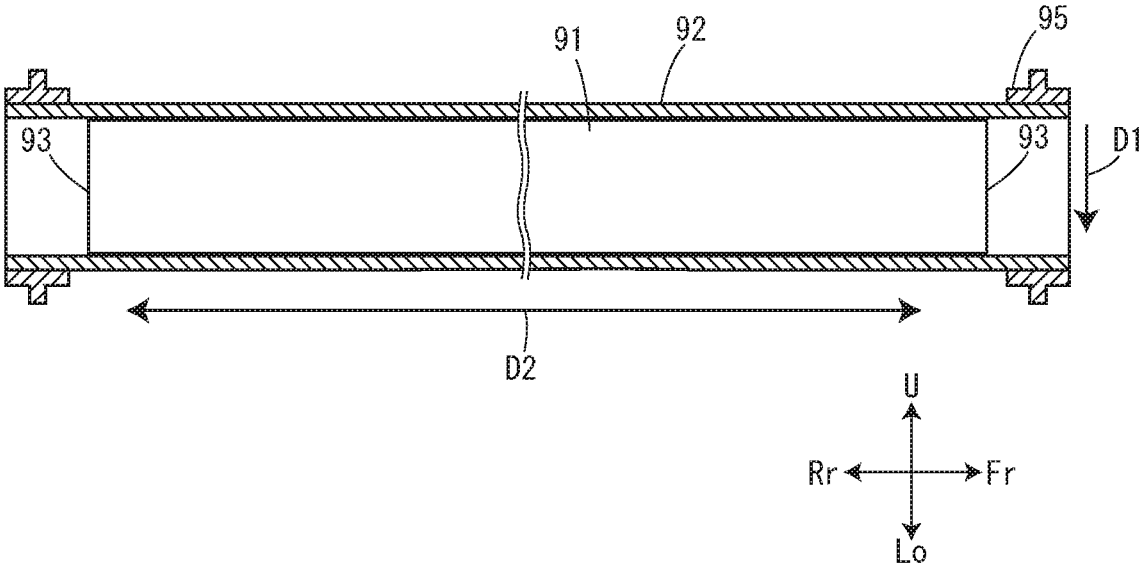
FIG. 3 prior art
FIG. 3 is a plan view showing a guide plate and a fixing belt according to a comparative embodiment.
Figure 4:
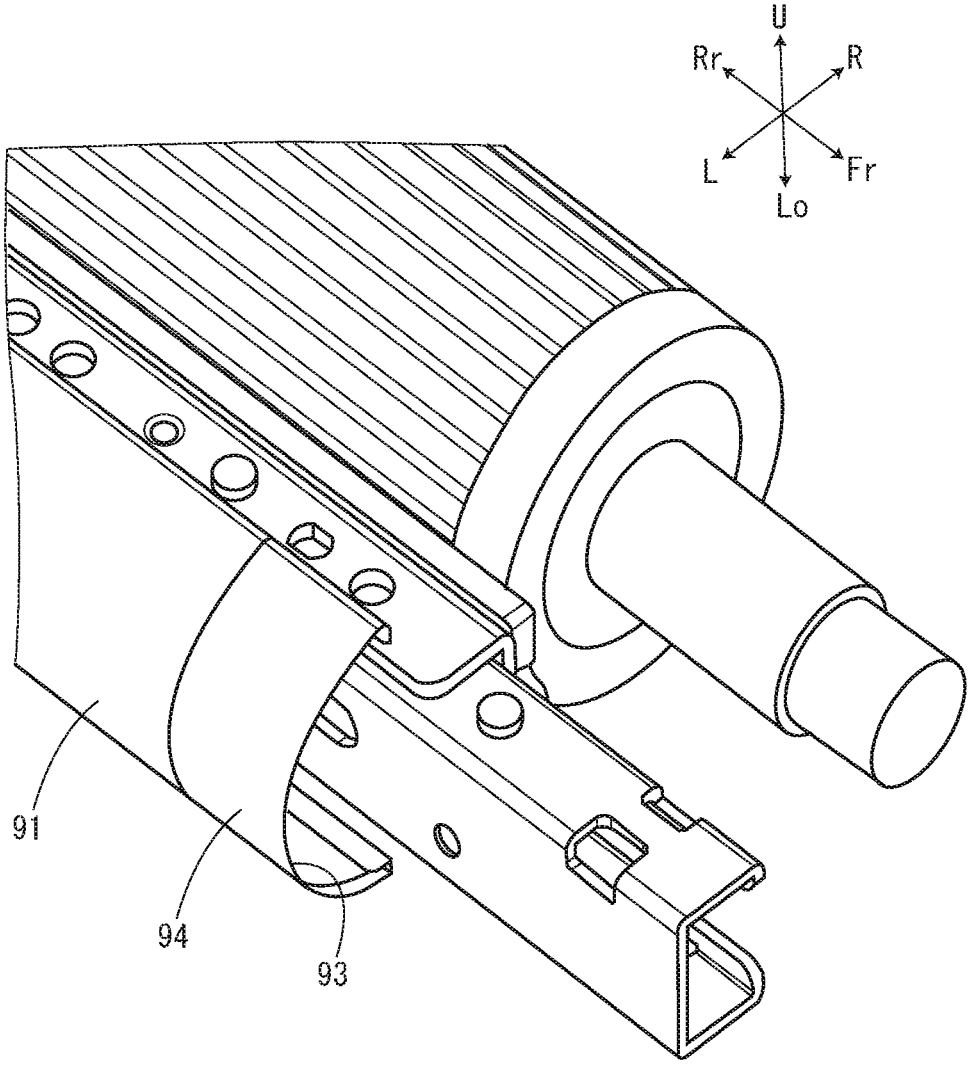
FIG. 4 prior art
FIG. 4 is a perspective view showing a fixing device according to the comparative embodiment.

Next, with reference to FIG. 2 to FIG. 4, the fixing device will be described. FIG. 2 is a view schematically showing the fixing device of the present embodiment. FIG. 3 is a plan view showing a guide plate and a fixing belt of a comparative embodiment. FIG. 4 is a perspective view showing a fixing device of the comparative embodiment. The arrow $D_L$ in FIG. 2 shows a sheet conveyance direction (a direction from the lower side to the upper side, in the present embodiment). For convenience of explanation, FIG. 3 shows the fixing belt in a sectional view and FIG. 4 does not show the fixing belt.

As shown in FIG. 2, the printer 1 (refer to FIG. 1) of the present embodiment applies the fixing device 33 of a belt-fixing type in which an unfixed toner image is fixed to the sheet using an endless fixing belt 41. The fixing device 33 includes the fixing belt 41 and a pressing roller 42 which face each other across the sheet conveyance path L to form a fixing nip N between the fixing belt 41 and the pressing roller 42. Inside the fixing belt 41, a center frame 43 and an auxiliary frame 44 are provided. The center frame 43 has an approximately rectangular C-shaped cross section long in a rotational axial direction of the fixing belt 41 (the front-and-rear direction). The auxiliary frame 44 having a rectangular U-shaped cross section covers the groove of the center frame 43.

To the right side wall of the auxiliary frame 44, a support member 45 is attached to support the fixing belt 41 from the inside. To the upper wall and the lower wall of the auxiliary frame 44, a guide plate 46 having an approximately semi-circular cross section to support a rotation of the fixing belt 41 is attached by support pieces 47 and 48. To the left side wall of the center frame 43, a temperature sensor 49 measuring a temperature of the fixing belt 41 is attached. Outside the fixing belt 41, an exciting coil 51 is provided so as to heat the fixing belt 41 from an opposite side to the pressing roller 42 (from the left side). To each of the end portions of the fixing belt 41, a cap 52 (refer to FIG. 6A) is provided so as to detect the rotation of the fixing belt 41.

The fixing belt 41 is formed into a cylindrical shape long in the rotational axial direction, and disposed so as to rotate with a conveyance of the sheet. The fixing belt 41 is a thin belt having a flexibility, and formed by a sliding layer, a base layer, an elastic layer and a release layer layered in the order from the inside to the outside, for example. The sliding layer is made of polyimide or fluorocarbon resin, the base layer is made of nickel or polyimide, the elastic layer is made of silicone rubber, and the release layer is made of fluorocarbon resin, for example. When the base layer is resin molded by polyimide, metal powder such as copper, silver or aluminum may be mixed with the polyimide.

The pressing roller 42 is formed into a columnar shape, and presses the fixing belt 41 on the support member 45 from the outside. The pressing roller 42 is formed by a columnar core material 53 rotatable around a rotational axis C1, an elastic layer 54 provided around the outer circumference of the core material 53 and a release layer (not shown) covering the outer circumferential face of the elastic layer 54. The core material 53 is made of metal such as stainless steel or aluminum, the elastic layer 54 is made of silicone rubber or silicone sponge, and the release layer is made of fluorocarbon-based resin, for example. To the pressing roller 42, a driving source 55 such as a motor is connected.

The support member 45 is formed into a long narrow plate, and made of heat-resistant resin such as liquid crystal polymer (LCP). The support member 45 faces the pressing roller 42 across the fixing belt 41, and supports the fixing belt 41 along the conveyance path L from the inside. The support member 45 has a support face 56 formed into a concave shape corresponding to the outer circumferential face of the pressing roller 42. The support face 56 is slightly inclined from the upstream side to the downstream side of the conveyance path L (from the lower side to the upper side) such that a thickness of the support member 45 is decreased. The pressing roller 42 presses the fixing belt 41 on the support face 56 of the support member 45, and the fixing belt 41 is deformed into a concave shape corresponding to the support face 56.

The guide plate 46 is formed to have an approximately arc-shaped cross section, and made of a long thin metal plate such as a stainless steel plate (for example, its thickness is 0.1 mm to 0.5 mm). The guide plate 46 is disposed on an opposite side to the support member 45 with respect to the rotational axis C2 and guides a rotation of the fixing belt 41 from the inside. In this case, the fixing belt 41 is applied with tension by a spring performance of the guide plate 46. An end edge shape of the guide plate 46 will be described later.

The temperature sensor 49 has a detection element (not shown) such as a thermistor, and makes the detection element come into contact with the inner face of the fixing belt 41 to measure a temperature of the fixing belt 41.

The exciting coil 51 faces the guide plate 46 across the fixing belt 41, and is formed into an arc shape along the outer face of the fixing belt 41. The exciting coil 51 is connected to an electric power source 57, and the electric power source 57 supplies a high frequency current to the exciting coil 51. When a high frequency current is supplied to the exciting coil 51 from the electric power source 57, a magnetic flux is generated. The magnetic flux is absorbed in the fixing belt 41, and then the fixing belt 41 is heated by induction heating. The cap 52 (refer to FIG. 6A) is provided in the end portion of the fixing belt 41, and a plurality of detection pieces 58 protrudes on the outer circumference of the cap 52. By detecting the detection piece 58 by a photo interrupter (not shown) or the like, a rotation of the fixing belt 41 is detected.

By the way, in the fixing device of the comparative embodiment shown in FIG. 3, in order to attach the caps 95 to both the end portions of the fixing belt 92 in the rotational axial direction D2, the fixing belt 92 is made to have a belt width in the rotational axial direction D2 larger than a guide width of the guide plate 91. Thereby, the fixing belt 92 protrudes from both the end edges 93 of the guide plate 91 in the rotational axial direction D2. Because the guide plate 91 is pressed on the inner face of the fixing belt 41, both the end edges 93 of the guide plate 91 come into forcefully contact with the inner face of the fixing belt 92. Because of a hardness of the guide plate 91 higher than the inner face of the fixing belt 41, when the fixing belt 92 is slid to the guide plate 91, the inner face of the fixing belt 92 wears partially.

In detail, both the longitudinally end edges 93 of the guide plate 91 are formed to have a straight shape parallel to the rotational direction D1. Thereby, while the fixing belt 92 is rotated from the upstream side to the downstream side in the rotational direction D1, the end edges 93 of the guide plate 91 continue to come into contact with the same positions on the inner face of the fixing belt 92, and then the fixing belt 92 may wear partially and be damaged. As shown in FIG. 4, when a protection seal 94 is attached to the end edge 93 of the guide plate 91, the wear of the fixing belt 92 can be avoided. However, because the protection seal 94 requires to have a heat resistance, a sliding wear resistance and a durability, the cost of the protection seal 94 is increased and an amount of work for attaching the protection seal 94 is increased.

Figure 6A:
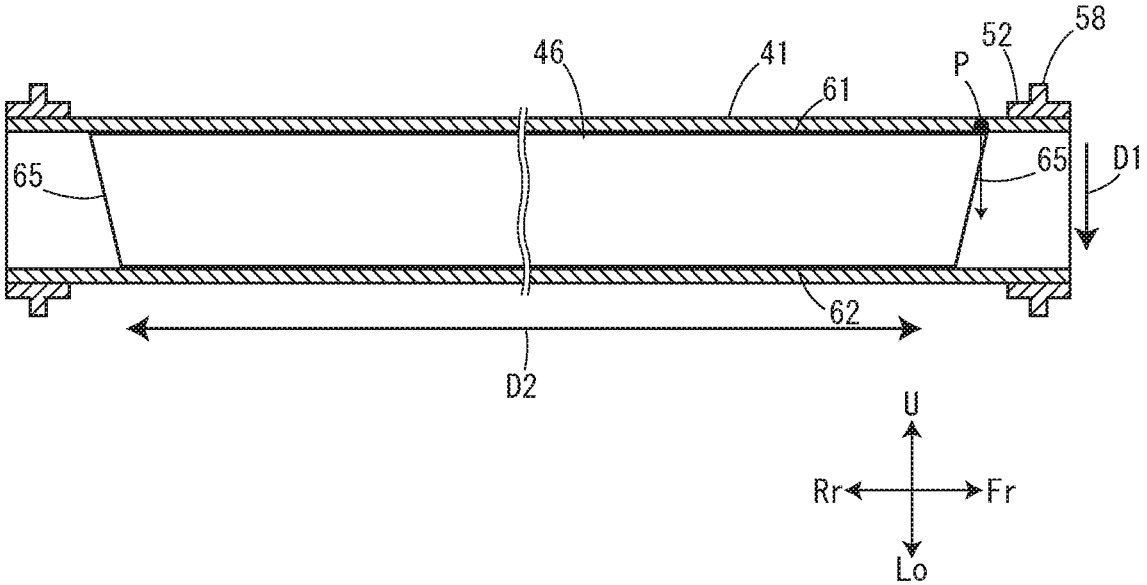
FIG. 6A is a plan view showing the guide plate and a fixing belt, in the fixing device according to the embodiment of the present disclosure.

Then, in the fixing device 33 of the present embodiment, the end edges 65 of the guide plate 46 are formed to have a shape containing an edge shape not parallel to the rotational direction D1 (the sliding direction) so that the end edges 65 of the guide plate 46 do not continuously come into contact with the same positions on the inner face of the fixing belt 41 (refer to FIG. 6A). Thereby, when the fixing belt 41 is slid to the guide plate 46, the partial wear of the fixing belt 41 owing to the contact between the inner face of the fixing belt 41 and the end edges 65 of the guide plate 46 is suppressed so that a durability of the fixing belt 41 can be improved. Additionally, because the protection seal 94 (refer to FIG. 4) is not necessary, the durability of the fixing belt 41 can be improved while preventing increase of the cost.

Figure 5:
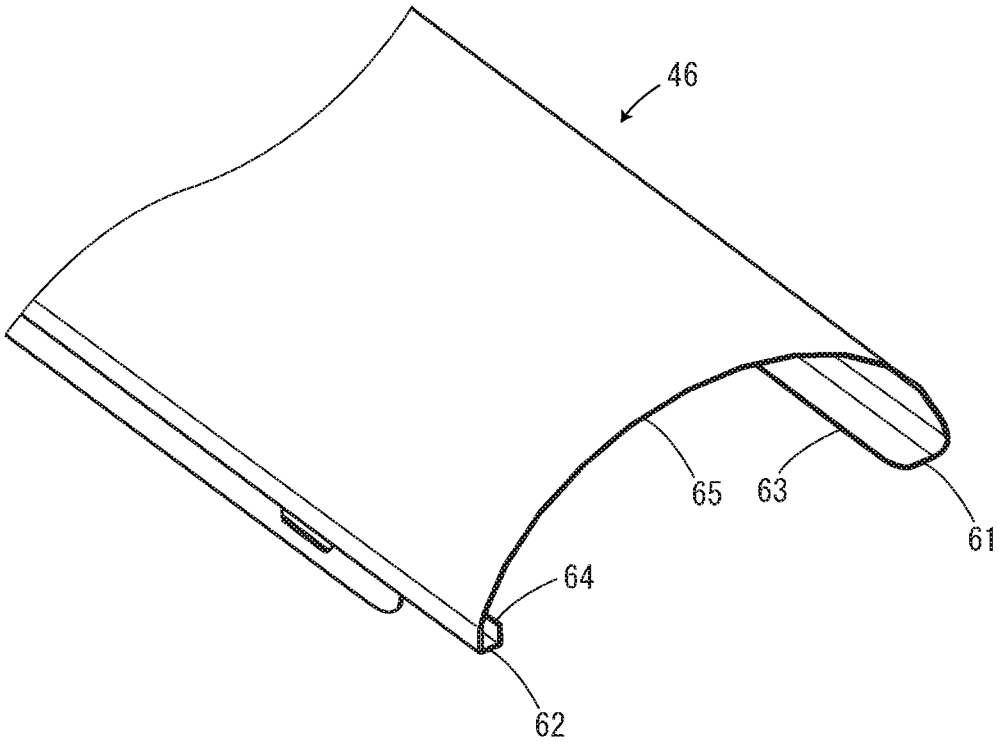
FIG. 5 is a perspective view showing an edge portion of a guide plate, in the fixing device according to the embodiment of the present disclosure.
Figure 6B:
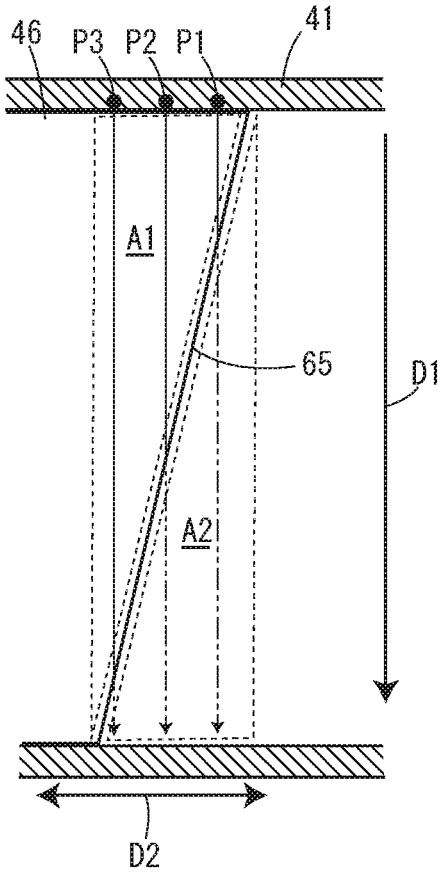
FIG. 6B is an enlarged view showing the edge portion of the guide plate, in the fixing device according to the embodiment of the present disclosure.

Hereinafter, with reference to FIG. 5, FIG. 6A and FIG. 6B, the shape of the end edge of the guide plate will be described. FIG. 5 is a perspective view showing the end edge of the guide plate of the present embodiment. FIG. 6A is a plan view showing the guide plate and the fixing belt of the present embodiment. FIG. 6B is an enlarged view showing the end edge of the guide plate. FIG. 6A shows a cross section of the fixing belt, for convenience of explanation.

As shown in FIG. 5 and FIG. 6A, the guide plate 46 is formed to have an approximately arc-shaped cross section, and pressed on the inner face of the fixing belt 41 entirely. One end portion 61 of the guide plate 46 in the shorter side direction is bent inward, and the other end portion 62 of the guide plate 46 in the shorter side direction is bent inward to have a rectangular U-shaped cross section. Because the end edges 63 and 64 of both the end portions 61 and 62 of the guide plate 46 protrude inside the guide plate 46, the end edges 63 and 64 of the guide plate 46 in the shorter side direction do not come into contact with the inner face of the fixing belt 41. Accordingly, the ware of the inner face of the fixing belt 41 owing to the end edges 63 and 64 of the guide plate 46 is suppressed.

Both the end edges 65 of the guide plate 46 in the longer side direction are formed to have an inclined shape crossing the rotational direction D1 of the fixing belt 41 in a plan view. The sliding direction of the fixing belt 41 and the extending direction of the end edge 65 of the guide plate 46 are obliquely intersected as the fixing belt 41 is rotated, so that the end edges 65 of the guide plate 46 do not continue to come into contact with the same positions on the inner face of the fixing belt 41. That is, an any position P on the fixing belt 41 is displaced in the rotational direction D1, and is passed through the end edge 65 of the guide plate 46 temporarily so that the position P on the fixing belt 41 does not displace along the end edge 65 of the guide plate 46. Accordingly, the end edge 65 does not continue to come into contact with the position P on the fixing belt 41 so that the partial wear of the fixing belt 41 can be suppressed.

Furthermore, as shown in FIG. 6B, the end edge 65 of the guide plate 46 is inclined inward in the rotational axial direction D2 from the upstream side to the downstream side in the rotational direction D1 of the fixing belt 41. Thereby, with respect to the end edge 65 of the guide plate 46, the upstream side portion of the end edge 65 in the rotational direction D1 is a contact area A1 between the fixing belt 41 and the guide plate 46, and the downstream side portion of the end edge 65 in the rotational direction D1 is a non-contact area A2 between the fixing belt 41 and the guide plate 46. When the inner face of the fixing belt 41 is slid on the surface of the guide plate 46, the inner face of the fixing belt 41 is passed through the end edge 65 from the contact area A1 to the non-contact area A2 so that the wear of the inner face of the fixing belt 41 is suppressed.

In detail, when the fixing belt 41 is rotated, the positions P1 to P3 on the fixing belt 41 are displaced from the contact area A1 to the non-contact area A2. When the position P1 to P3 on the fixing belt 41 are passed through the end edge 65, the positions P1 to P3 coming into contact with the guide plate 46 previously are separated from the guide plate 46. Thereby, like a case where the inner face of the fixing belt 41 is slid on the guide plate 46 from the non-contact area A2 to the contact area A1, a portion not coming into contact with the guide plate 46 does not start to come into contact with the end edge 65. Accordingly, the inner face of the fixing belt 41 is not abraded by the end edges 65 of the guide plate 46.

As described above, according to the present embodiment, because a guide width of the guide plate 46 is smaller than a belt width of the fixing belt 41, both the end edges 65 of the guide plate 46 in the rotational axial direction D2 of the fixing belt 41 come into contact with the inner face of the fixing belt 41. At this time, because the end edge 65 of the guide plate 46 has a shape containing an inclined shape not parallel to the rotational direction D1 of the fixing belt 41, the end edges 65 of the guide plate 46 do not continue to come into contact with the same positions on the inner face of the fixing belt 41. Accordingly, the partial wear of the fixing belt 41 owing to the contact between the end edges 65 of the guide plate 46 and the inner face of the fixing belt 41 is suppressed so that the durability of the fixing belt 41 can be improved. Additionally, because the expensive protection seal 94 for the end edge 65 of the guide plate 46 is not necessary, the life of the fixing belt 41 of the fixing device 33 can be improved without increase of the cost and the amount of the working steps.

Additionally, by using the fixing device 33 of the present embodiment for the printer 1 (refer to FIG. 1), it becomes possible to decrease a frequency of the maintenance work and the replacement work of the fixing device 33.

Figure 7:
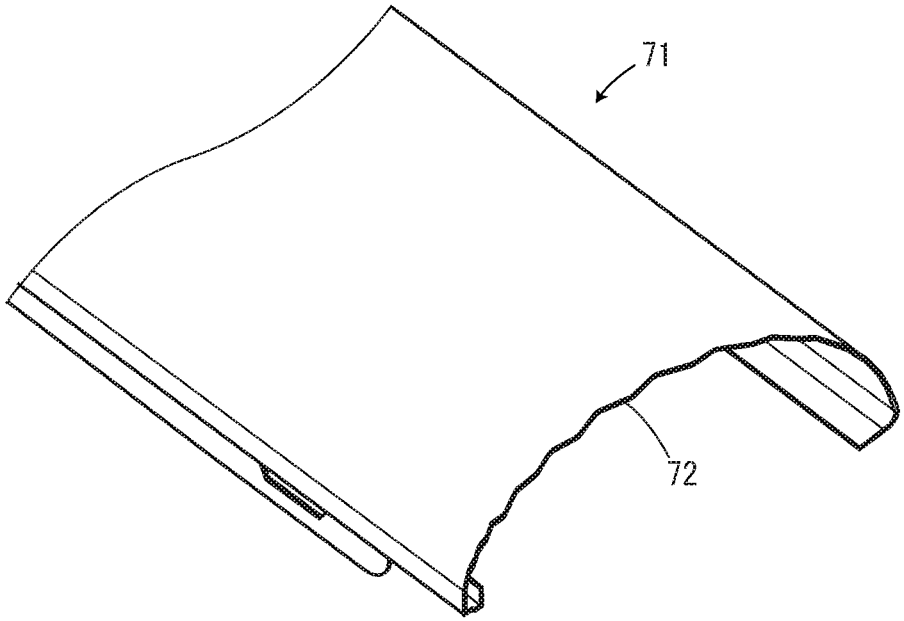
FIG. 7 is a perspective view showing the edge portion of the guide plate of a first modified example of the fixing device according to the embodiment of the present disclosure.

The shape of the end edge 65 of the guide plate 46 is not limited to an inclined shape in a plan view. The shape of the end edge 65 of the guide plate 46 may be a shape containing a shape not parallel to the rotational direction D1 of the fixing belt 41. Hereinafter, with reference to FIG. 7 to FIG. 11, modified examples of the guide plate will be described. FIG. 7 is a perspective view showing the end edge of the guide plate in a first modified example. FIG. 8 to FIG. 11 are plan views showing the guide plate and the fixing belt in the first to the fourth modified examples. FIG. 8 to FIG. 11 show a cross section of the fixing belt for convenience of explanation. The explanation of the same structures as the above present example are omitted.

Figure 8:
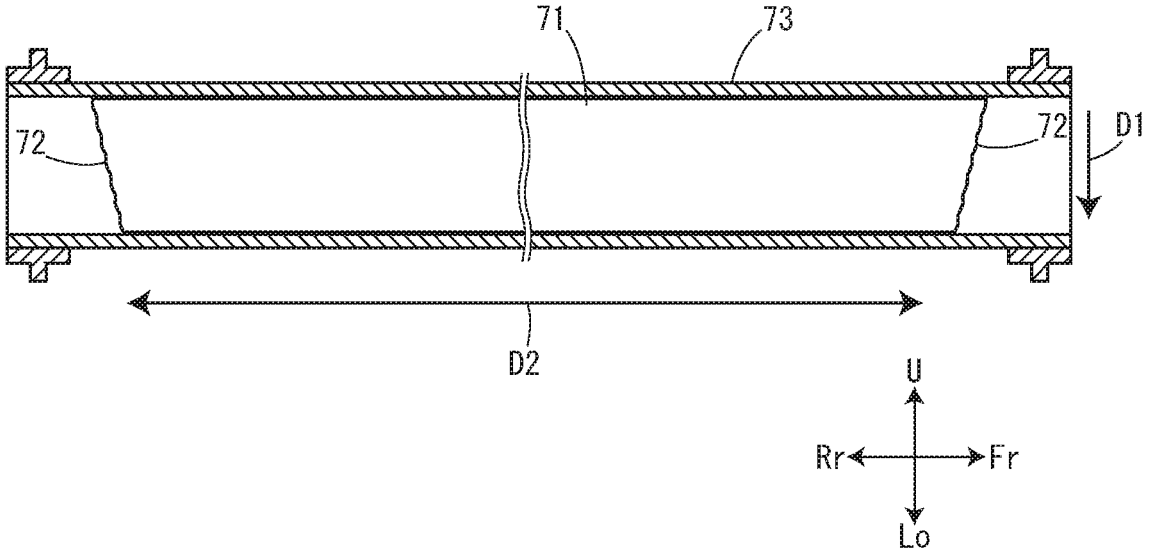
FIG. 8 is a plan view showing the guide plate and the fixing belt of the first modified example of the fixing device according to the embodiment of the present disclosure.

As shown in FIG. 7 and FIG. 8, the end edge 72 of the guide plate 71 is formed to have a corrugated shape crossing the rotational direction D1 of the fixing belt 73 in a plan view. By the shape, the end edge 72 of the guide plate 71 does not continue to come into contact with the same position on the inner face of the fixing belt 41, and the partial wear of the fixing belt 73 can be suppressed. The corrugated end edge 72 of the guide plate 71 is inclined inward in the rotational axial direction D2 from the upstream side to the downstream side in the rotational direction D1 of the fixing belt 73. Accordingly, when the inner face of the fixing belt 73 is slid on the surface of the guide plate 71, the fixing belt 73 is not abraded by the end edge 72 of the guide plate 71.

Figure 9:
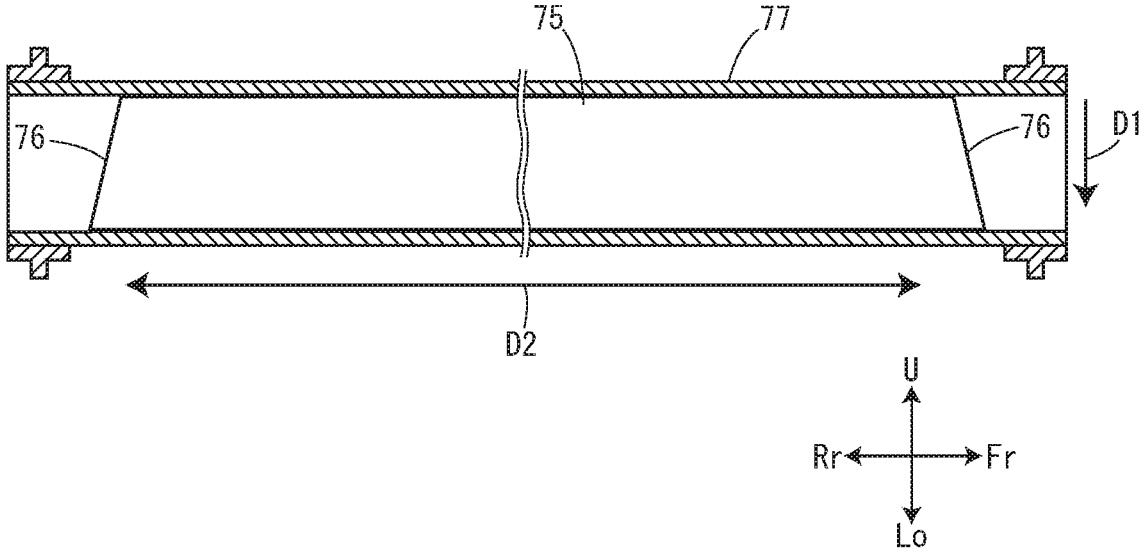
FIG. 9 is a plan view showing the guide plate and the fixing belt of a second modified example of the fixing device according to the embodiment of the present disclosure.
Figure 10:
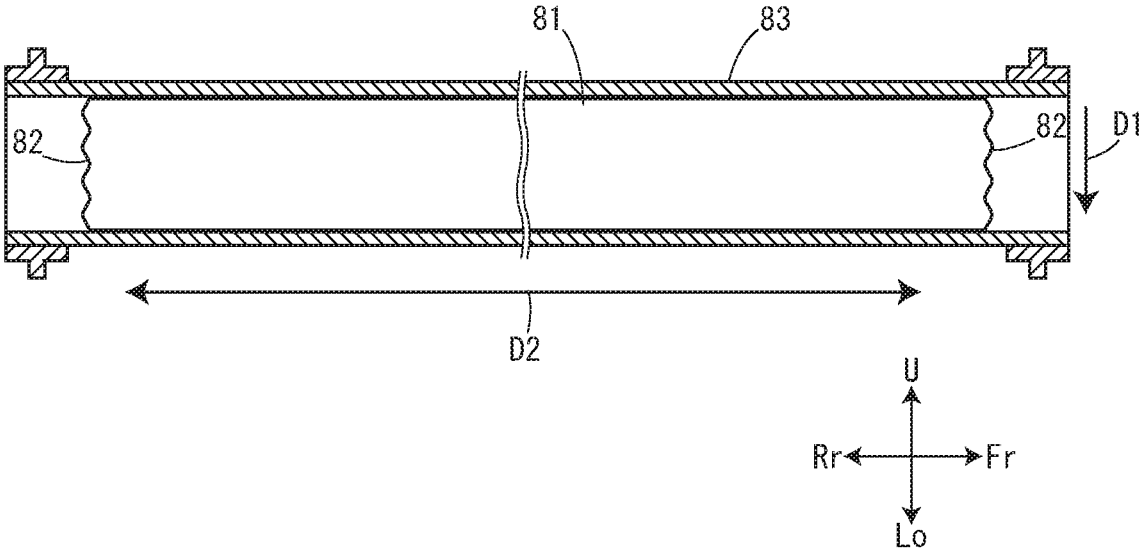
FIG. 10 is a plan view showing the guide plate and the fixing belt of a third modified example of the fixing device according to the embodiment of the present disclosure.
Figure 11:
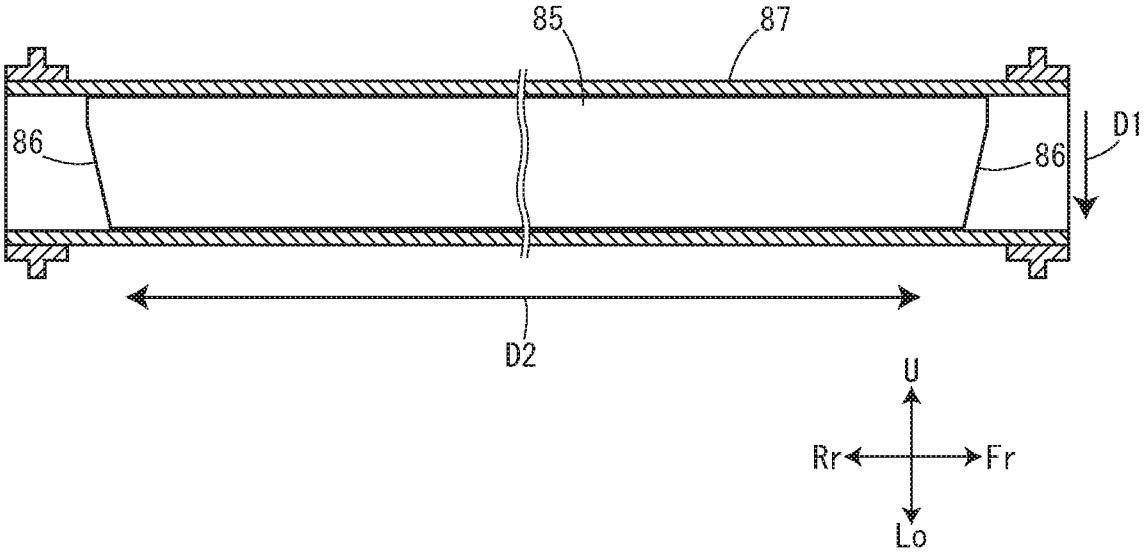
FIG. 11 is a plan view showing the guide plate and the fixing belt of a fourth modified example of the fixing device according to the embodiment of the present disclosure.

As shown in FIG. 9, in order to only suppress the partial wear of the fixing belt 77, the end edge 76 of the guide plate 75 may be have an inclined shape inclined outward in the rotational axial direction D2 from the upstream side to the downstream side in the rotational direction D1 of the fixing belt 77. Alternatively, as shown in FIG. 10, the end edge 82 of the guide plate 81 may be have a corrugated shape along the rotational direction D1 of the fixing belt 83. Furthermore, as shown in FIG. 11, the entire of the end edge 86 of the guide plate 85 does not need to have a shape not parallel to the rotational direction D1 of the fixing belt 87. The end edge 86 of the guide plate 85 may have a shape parallel to and a shape not parallel to the rotational direction D1 of the fixing belt 87.

In the present embodiment, although the printer 1 is described as an example of the image forming apparatus, the image forming apparatus may be a copying machine, a facsimile, a multifunctional peripheral (an apparatus containing a printing function, a copying function and a facsimile function totally).

Although the present embodiment has been described, as other embodiments, the above embodiment and the modified examples may be combined in whole or in part.

The technique of the present disclosure is not limited to the above described embodiment, and may be modified, replaced and changed variously without departing from the spirit of the technical idea. Further, if the technical idea can be realized by another way using the advance of the technology or another technology derived from it, the technique of the present embodiment may be performed using the method. Accordingly, the claims cover all embodiment that may be included within the scope of the technical idea.

Although the present disclosure described the specific embodiment, the present disclosure is not limited to the embodiment. It is to be noted that one skilled in the art can modify the embodiment without departing from the scope and spirit of the present disclosure.

The invention claimed is:

1. A fixing device to fix an unfixed toner image transferred on a sheet to the sheet, the fixing device comprising:

a fixing belt having endless shape and rotating with a conveyance of the sheet;

an exciting coil is provided outside the fixing belt;

a guide plate made of a thin metal plate, facing the exciting coil, and guiding the fixing belt from an inside of the fixing belt so as to rotate;

a support member supporting the fixing belt along a conveyance path of the sheet from the inside; and a pressing roller pressing the fixing belt on the support member from an outside of the fixing belt, wherein in a rotational axial direction of the fixing belt, the fixing belt has a belt width wider than a guide width of the guide plate, and the fixing belt protrudes from both end edges of the guide plate, and both the end edges of the guide plate in the rotational axial direction are formed to have an inclined shape inclined inward in the rotational axial direction from an upstream side to a downstream side in the rotational direction.

2. The fixing device according to claim 1; comprising a cap provided in an end portion of the fixing belt and having a detection piece protruding from the cap, the detection piece detecting a rotation of the fixing belt, wherein the fixing belt has a belt width wider than a guide width of the guide plate in the rotational axial direction of the fixing belt in order to attach the cap to the fixing belt.

3. An image forming apparatus comprising:

an image forming part forming the unfixed toner image on the sheet; and the fixing device according to claim 1.

* * * * *